US007896662B2

(12) United States Patent
Chen

(10) Patent No.: US 7,896,662 B2
(45) Date of Patent: Mar. 1, 2011

(54) PIN CONNECTOR WITH NOTCHES ON SOLDERING SURFACES OF PINS

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/580,279

(22) Filed: Oct. 16, 2009

(65) Prior Publication Data

US 2010/0099280 A1 Apr. 22, 2010

(30) Foreign Application Priority Data

Oct. 16, 2008 (CN) ..... 2008 2 0186286

(51) Int. Cl.
*H01R 12/00* (2006.01)

(52) U.S. Cl. ..... 439/83

(58) Field of Classification Search ..... 439/83, 439/412, 417, 876, 874, 973, 590
See application file for complete search history.

(56) References Cited

U.S. PATENT DOCUMENTS

| | | | | |
|---|---|---|---|---|
| 4,678,250 | A | 7/1987 | Romine et al. | |
| 5,104,324 | A | 4/1992 | Grabbe et al. | |
| 5,373,626 | A * | 12/1994 | Youngfleish | 29/739 |
| 5,957,739 | A * | 9/1999 | Bianca et al. | 439/885 |
| 6,224,399 | B1 * | 5/2001 | Yacoub | 439/83 |
| 7,247,051 | B2 | 7/2007 | Hou | |
| 2010/0099280 | A1 * | 4/2010 | Chen | 439/83 |

* cited by examiner

*Primary Examiner*—Neil Abrams
*Assistant Examiner*—Phuongchi Nguyen
(74) *Attorney, Agent, or Firm*—Wei Te Chung; Andrew C. Cheng; Ming Chieh Chang

(57) ABSTRACT

A pin connector includes an insulating housing defining pin-retaining-holes and connector pins retained in the retaining holes. Each of the connector pin has a header portion with a soldering face thereof and a shank portion extending from the header portion. The header portion defines notches opening through the soldering face.

19 Claims, 5 Drawing Sheets

PIN CONNECTOR WITH NOTCHES ON SOLDERING SURFACES OF PINS

BACKGROUND OF THE INVENTION

1. Field of the Invention

The present invention relates to a connector which includes conductive connector pins and an insulator housing, the connector pin being press-fitted within a pin retaining hole formed in the housing.

2. Description of the Related Art

U.S. Pat. No. 7,247,051 issued on Jul. 24, 2007 to Advanced Connector Inc. disclosed a pin connector. The pin connector has insulating housing and connector pins received and retained in the holes of the housing. The pins has a smaller upper end projecting above the upper face of the housing and a larger lower end retained in the housing which has a soldering face parallel to the lower face confronting to a printed circuit board, of the housing. The soldering area of the pin might be small if the whole pin are small, which might be result in a bad connection between the connector and the PCB. Thus, the need for improved still exists in order to overcome the inadequacies of the related art.

BRIEF SUMMARY OF THE INVENTION

A pin connector comprises an insulating housing comprises pin retaining holes and connector pins retained in the retaining holes. Each of the connector pin has a header portion with a soldering face thereof and a shank portion extending from the header portion. The header portion defines notches opening through the soldering face.

Advantages and novel features of the invention will become more apparent from the following detailed description of the present embodiment when taken in conjunction with the accompanying drawings.

BRIEF DESCRIPTION OF THE DRAWINGS

The invention may be best understood by reference to the following description taken in conjunction with the accompanying drawings, in which like reference numerals identify like members in the figures and in which.

DESCRIPTION OF PREFERRED EMBODIMENT OF THE INVENTION

Figure 1:
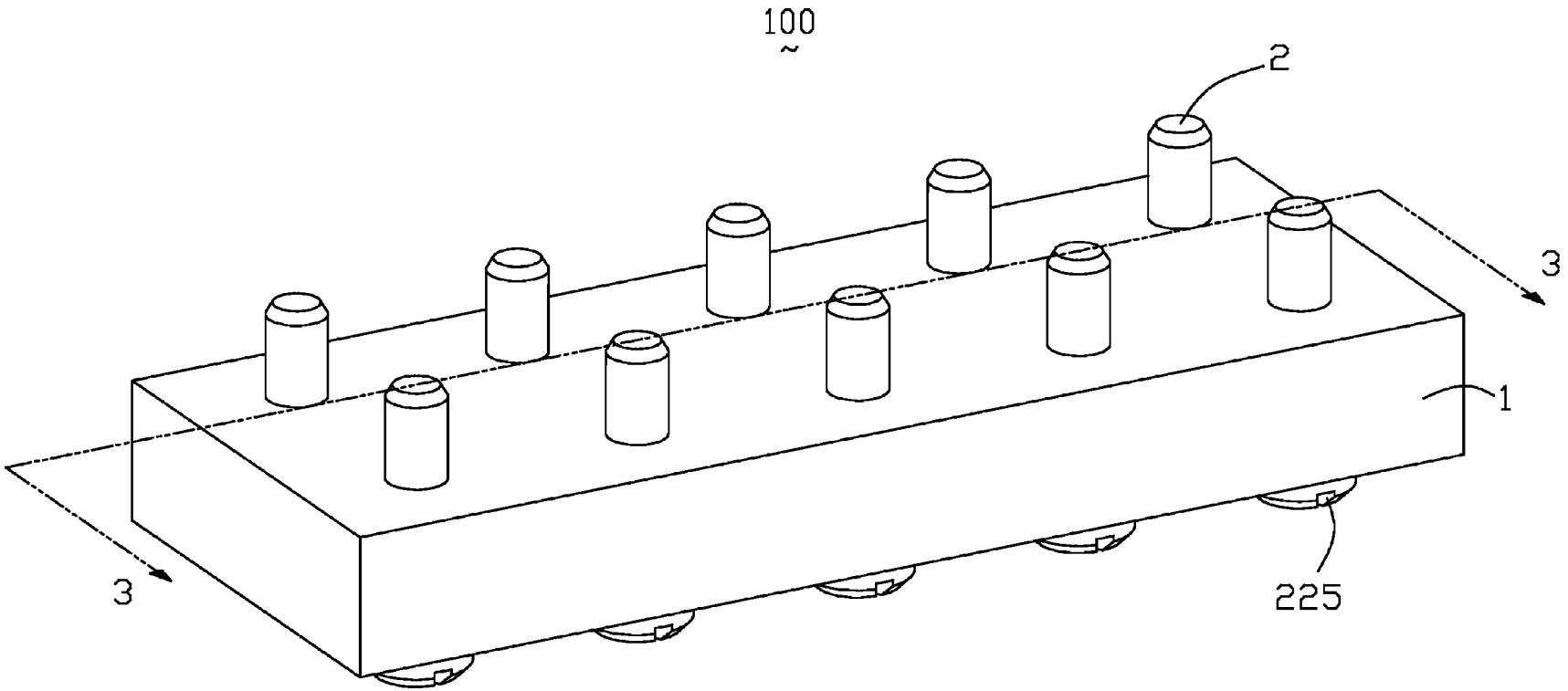
FIG. 1 is a top perspective view of a pin connector according to a first embodiment of the present invention.
Figure 2:
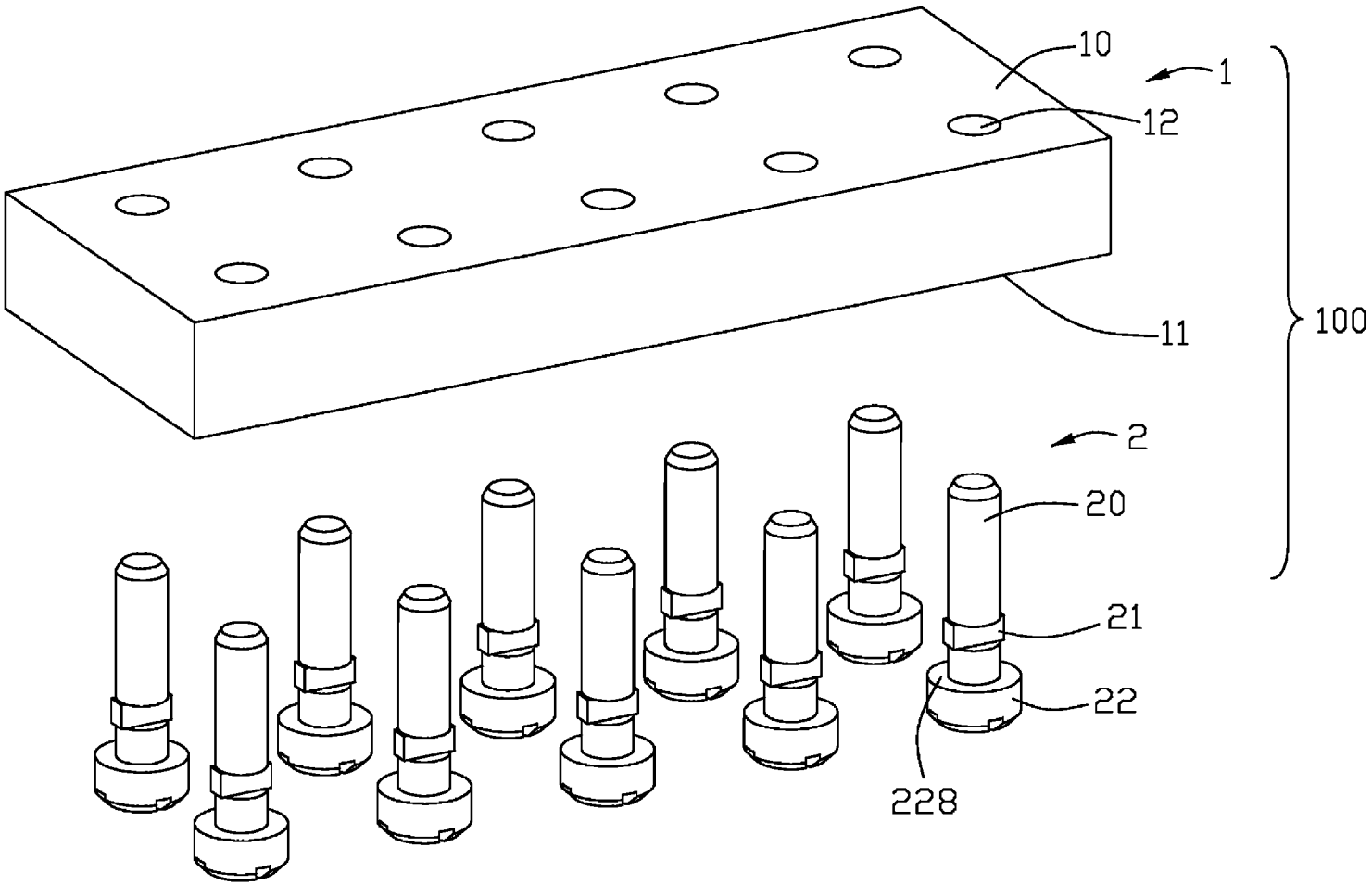
FIG. 2 is an exploded perspective view of the pin connector shown in FIG. 2.

In the following detailed description, for purposes of explanation, numerous specific details are set forth in order to provide a thorough understanding of the present invention.

FIGS. 1 through 4 show a connector 100 relating to a first embodiment of the invention. This connector 100 is embodied as a so-called pin connector having the basic construction common to the connectors of this type. The connector 100 includes a housing 1 made of insulating material such as synthetic resin, which housing defines two rows of pin retaining holes 12 each allowing press-fitting of a connector pin 2 therein. The connector pin 2 is of cylindrical bolt shape and has a head portion 22 which can be connected, by means of e.g. soldering, to a terminal of a print circuit board (not shown) disposed below and a long thin shank portion 20 which can be connected, by way of e.g. insertion, to a terminal of another circuit board (not shown) disposed above. The shank portion 20 extends from the header portion 22. The connector pin 2 further includes a stopping portion 21 at an intermediate portion of the shank portions 20 for being interfered to the inner peripheral face of the pin retaining holes 12, thus preventing withdrawal of the connecting pin 2 to the inserting side.

The connector pin 2 is press-fitted into the pin retaining hole 2 from a lower face or second face 11 with an upper end 201 of the shank portions 20 above the upper face or first face 10 to function as a mating end. Since the header portion 22 has a lager diameter than shank portions 21 in the cross section, the upper face 228 of the header portion 22 abuts against the lower face 11 of the housing for preventing the pin from upwardly over-moving. The lower face of the header portion 22 is functioned as a soldering face 222. The header portion 22 tapers inwards and downwards so as to decrease area of the soldering face 222. The header portion defines four substantial inverted pyramid notches 225, each of which opens downwards through the soldering face 222 thereof and outwards through the outer peripheral side face 221. The notches 225 benefit the gas permeability in soldering process when the connector is soldered to the PCB. The notches 225 reduce the level soldering face 222 on the PCB while the inner faces of notches 225 increase the soldering area.

The shank portion 20 has a lower end 202 above the header portion 22 received in the hole 12 and the stopping portion 21 is set on said lower end 202. The stopping portion of block-like shape has a pair of opposite longitudinal ends 211 which project out the outer periphery side face of the shank portion and a middle portion 212 between said opposite ends hiding in the outer periphery side face circle of the shank portion 21 oppositely.

Figure 3:
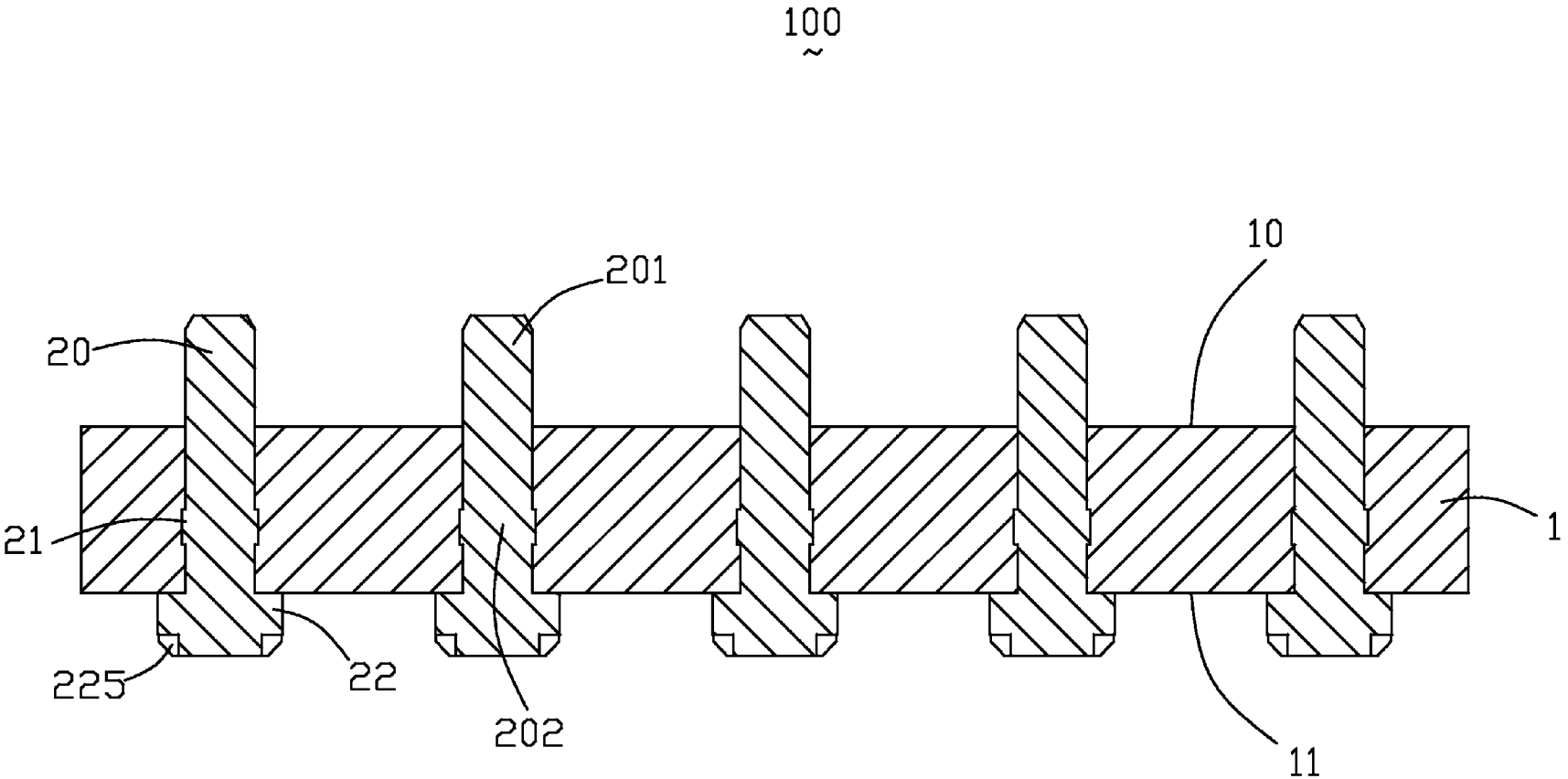
FIG. 3 is a cross-section view of the pin connector taken along line 3-3 in FIG. 1.
Figure 4:
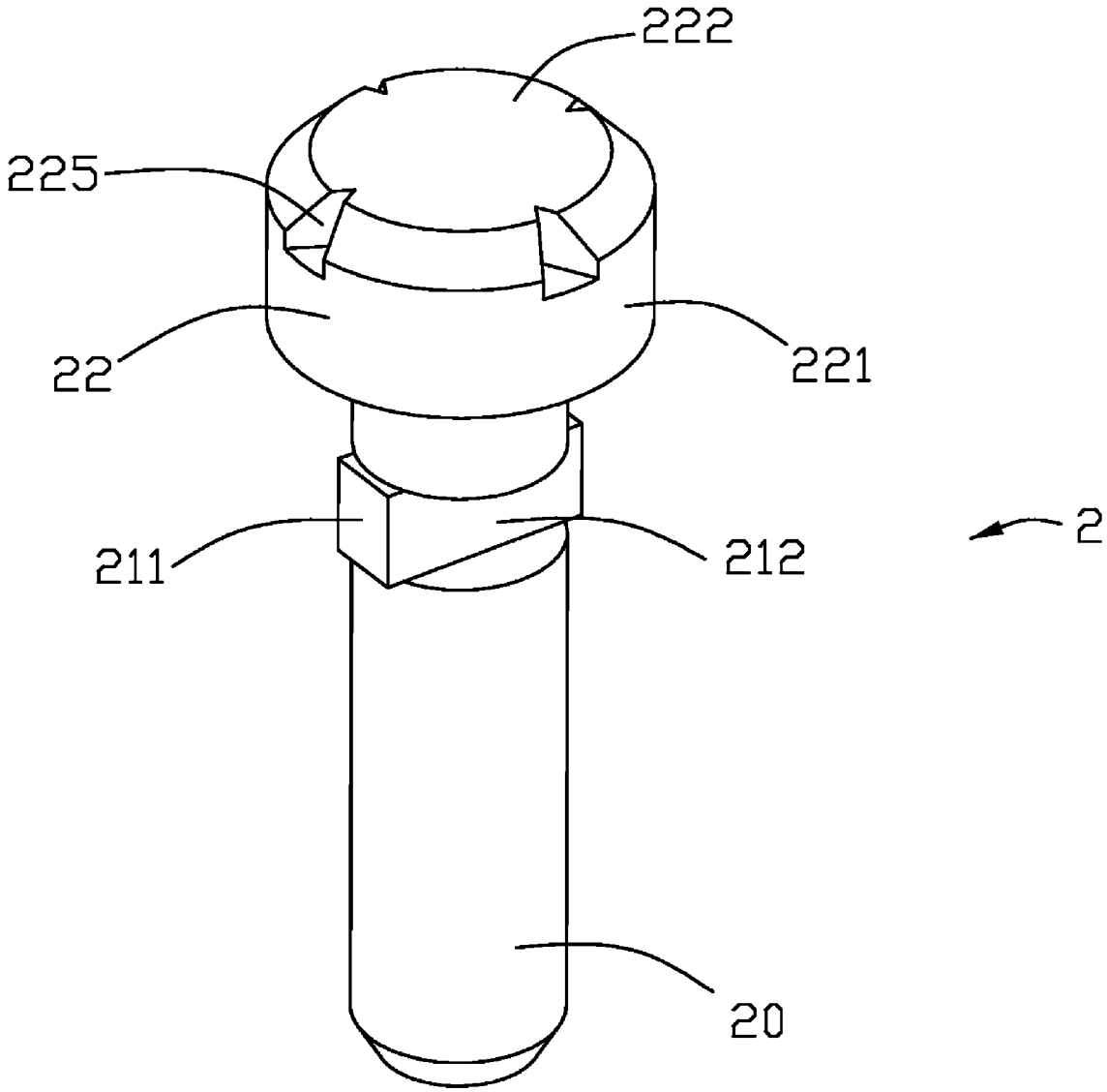
FIG. 4 is an enlarged perspective view of the connector pin.
Figure 5:
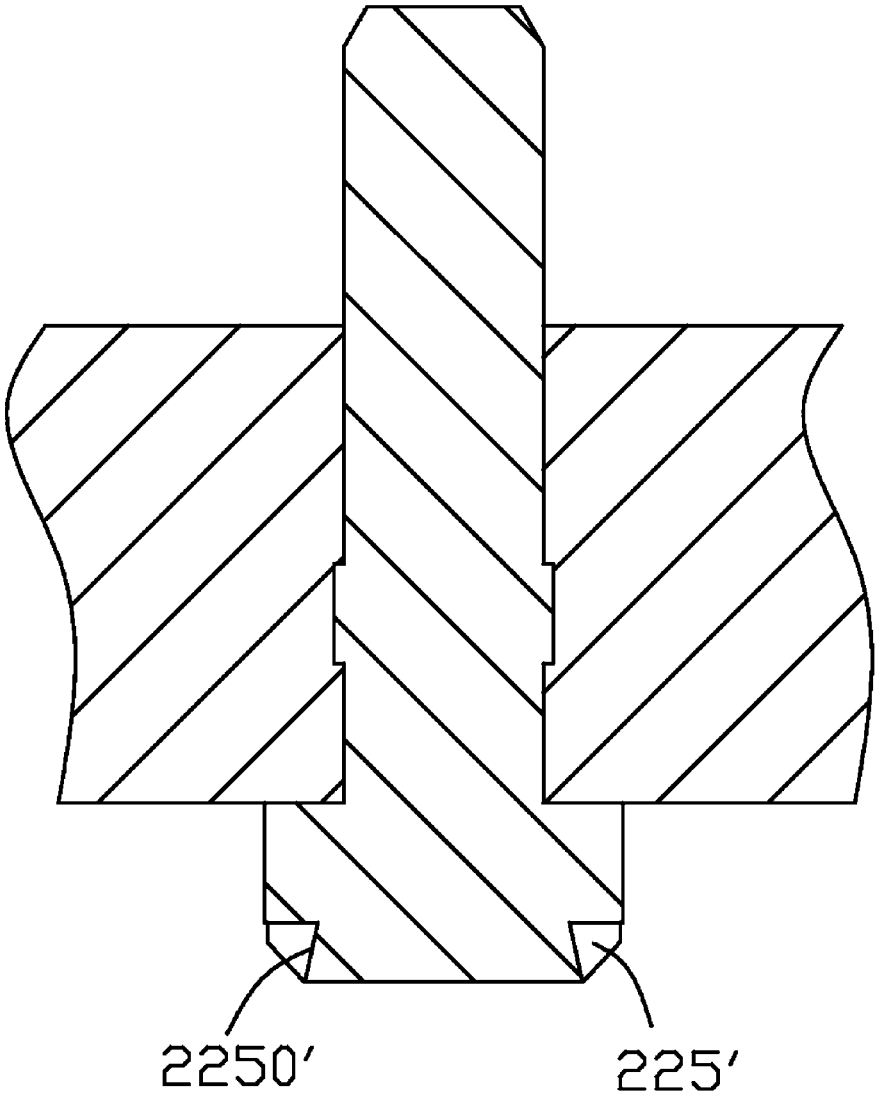
FIG. 5 is a cross-section view of a pin connector of another embodiment similar to FIG. 3.

Please seeing FIGS. 3 and 5 shown the cross sections of the notches, the notch 225 of the first embodiment has a top inner face and an upright inner face perpendicular to each other while the notch 225' has a top inner face and a slant inner face 2250'.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A pin connector comprising:

an insulating housing comprising pin retaining holes; and connector pins retained in the retaining holes, each connector pin comprising a header portion with a soldering face and a shank portion extending from the header portion; wherein the header portion defines inverted pyramid notches around the soldering face;

the notches located at an outer periphery side face of the header portion;

the shank portion defines a lower end retained in the pin retaining hole and the header portion has an upper face abutting against a lower face of the insulating housing;

the lower end of the shank portion defines a stopping portion thereon;

the stopping portion defines a pair of opposite longitudinal sidewalls projecting out an outer periphery side face of the shank portion; and another pair of sidewalls, extending transverse from the longitudinal sidewalls, are located between the longitudinal sidewalls of the stopping portion, which is hidden within the outer periphery side face of the shank portion.

2. The pin connector as recited in claim 1, wherein the notches located at an inclined surface of the header portion.

3. The pin connector as recited in claim 2, wherein the header portion tapers inwards and outwards at the soldering face so as to decrease the soldering face.

4. The pin connector as recited in claim 2, wherein a diameter of the shank portion is smaller than a diameter of the header portion.

5. The pin connector as recited in claim 2, wherein there are four notches on the soldering face symmetrically.

6. The pin connector as recited in claim 2, wherein the notch has a top inner face and an upright inner face.

7. The pin connector as recited in claim 2, wherein the notch has a top inner face and a slant inner face.

8. The pin connector as recited in claim 2, wherein, the head portion are mounted on a printed circuit board.

9. The pin connector as recited in claim 8, wherein; the stopping portion is located at an intermediate portion of the shank portion.

10. The pin connector as recited in claim 9, wherein; the connector pin is of cylindrical bolt shape.

11. The pin connector as recited in claim 10, wherein; the header portion tapers inwards and down wards so as to decrease area of the soldering face.

12. A pin connector comprising:

an insulating housing comprising holes running through a first face and a second face opposite to the first face thereof;

connector pins, each comprising a header portion with a soldering face below the second face and an shank portion extending from the header portion, the shank portion having one smaller diameter compared with the header portion, the shank portion defining an upper end above the first face of the insulating housing and a lower end retained in the hole;

the header portion defines inverted pyramid notches around the soldering face;

the notches located at an outer periphery side face of the header portion;

the lower end of the shank portion defines a stopping portion thereon;

the stopping portion defines a pair of opposite longitudinal sidewalls projecting out an outer periphery side face of the shank portion; and another pair of sidewalls, extending transverse from the longitudinal sidewalls, are located between the longitudinal sidewalls of the stopping portion, which is hidden within the outer periphery side face of the shank portion.

13. The pin connector as recited in claim 12, wherein the header portion tapers inwards and down wards so as to decrease area of the soldering face.

14. The pin connector as recited in claim 12, wherein; the stopping portion is located at an intermediate portion of the shank portion.

15. The pin connector as recited in claim 14, wherein the header portion has a face abutting against the second face of the insulating housing.

16. A pin connector comprising:

an insulative housing defining opposite upper and lower faces thereof; a plurality conductive pins assembled to the housing, each of said pins including a large header portion with opposite seating face and soldering face thereon under condition that the seating face abuts against the lower face of the housing, and the soldering face facing downward toward a printed circuit board onto which said soldering face is fastened, and a shank portion extending above the upper face with a stopper portion located between the header portion and the shank portion to be deep embedded in the housing, wherein a plurality of inverted pyramid recesses are formed in the soldering face around a periphery thereof under condition that each of said recesses communicates with an exterior in both downward and outwardly radial directions for receiving corresponding solder;

the stopping portion defines a pair of opposite longitudinal sidewalls projecting out an outer periphery side face of the shank portion; and another pair of sidewalls, extending transverse from the longitudinal sidewalls, are located between the longitudinal sidewalls of the stopping portion, which is hidden within the outer periphery side face of the shank portion.

17. The pin connector as claimed in claim 16, wherein a chamfered structure is formed along a periphery of said soldering face, and said recesses are inwardly recessed from said chamfered structure.

18. The pin connector as claimed in claim 16, wherein each of said recesses is spanned in a fan-like manner.

19. The pin connector as claimed in claim 16, wherein each of said recess defines an upward and inward slanted inner face for interlocking the corresponding solder therein.

* * * * *